United States Patent [19]

Jucker

[11] 4,367,684

[45] Jan. 11, 1983

[54] SAFE HAVING LATERALLY RETRACTABLE SWING DOOR WINGS

[75] Inventor: Hans Jucker, Horgen, Switzerland

[73] Assignee: Tell-Kassenfabrik und-Tresorbau, Brack & Peter, Inh. Jucker & Co., Switzerland

[21] Appl. No.: 292,491

[22] Filed: Aug. 13, 1981

[30] Foreign Application Priority Data

Sep. 4, 1980 [CH] Switzerland ..... 6645/80

[51] Int. Cl.[3] ..... E05D 15/56

[52] U.S. Cl. ..... 109/70; 49/257

[58] Field of Search ..... 109/69, 70, 71; 49/40, 49/257

[56] References Cited

U.S. PATENT DOCUMENTS

| | | | |
|---|---|---|---|
| 958,624 | 5/1910 | Glazier | 109/70 |
| 2,598,255 | 5/1932 | Heinkel | 49/257 |
| 4,058,932 | 11/1977 | Peterson | 40/257 |
| 4,089,135 | 5/1978 | Beny et al. | 49/257 |
| 4,294,040 | 10/1981 | Crotti | 109/70 |

*Primary Examiner*—Gene Mancene
*Assistant Examiner*—Wenceslao J. Contreras
*Attorney, Agent, or Firm*—McGlew and Tuttle

[57] ABSTRACT

A safe having laterally rectractable door wings is disclosed. At either side of the door opening of a safe, a retraction space is provided extending both upwardly and downwardly, and in the rear, beyond the useful space of the safe. Each of two door wings is hinged to a movable supporting column which is guided at its top and bottom, by guide rollers running in guideways which extend obliquely inwardly to the rear of the safe. A column carries a plate firmly secured thereto and supports two track rollers which are mounted at locations spaced apart horizontally and vertically. Track rollers run along a guide rail, one on the upper and the other on the lower track surface thereof. The track surfaces have a convex cross-section. The guide rail extends exactly parallel to the guideways. The positions of the guide rail, guideways and track rollers are adjustable. A fixed guide roller engaging a groove on the underside of a respective door wing, forms the pivot axis for the wing. In its open position, the wing is received in the retraction space while extending perpendicularly to the closed door plane and closes the opening of the retraction space.

7 Claims, 3 Drawing Figures

8
3
6
6b
15
1a
6a
9
4
1
11
10

SAFE HAVING LATERALLY RETRACTABLE SWING DOOR WINGS

FIELD AND BACKGROUND OF THE INVENTION

The present invention relates to safes in general and, more particularly, to a new and useful safe of the type having one or more door wings for opening and closing a door opening of the type in which the door wing is retracted into a space disposed on the side of the safe.

There are known designs of this kind in which either the space needed for swinging out the door wings, or the width of the lateral spaces into which the door wings are to be retracted, are very large. Thus, there are provisions for pivotably mounting a door wing on a vertical column with the column being guided, by means of rollers, along a horizontal rail extending rearwardly. In such designs, the guidance of the column on the rail and the exact position of the rail have proven to be particularly critical.

SUMMARY OF THE INVENTION

To avoid the known drawbacks and to insure a smooth and complete retraction of the door wings of a safe of the above-mentioned type into a relatively narrow lateral space, the invention provides an arrangement in which a safe of the type having a case defining an enclosed volume and a door opening opened to the volume, a wall for dividing the volume into a useful space and a retraction space laterally adjacent to the useful space and at least one door wing for opening and closing the door opening, the improvement wherein the door wing is laterally swingable out of the door opening and concurrently retractable into the retraction space which includes a supporting column, a hinge swingably mounting the door wing to the supporting column, a guide roller mounted for rotation in engagement with the door wing in or within the proximity of the retraction space, a guide reail extending obliquely inwardly through the retraction space from the plane of the door opening, an elongated supporting plate fixedly mounted to the supporting column, a first roller and a second roller mounted to the supporting plate at horizontally and vertically spaced offset positions and engaged to the guide rail for rotation therealong and, wherein, the supporting column is movable along the guide rail so that, to open the safe, the door wing is pivoted from its closed position in the door opening plane about the hinge access of the hinge and is simultaneously shifted on and turned about the guide roller through 90° and moved into an open position in which an edge of the door wing is flush with the door opening plane.

It has been found particularly advantageous to provide an angle ranging from eighty degrees to eighty-five degrees between the obliquely inwardly extending guide rail and the plane of the door opening. The vertical plane passing through the axes of the hinge frontally secured to the door wing face, and the door plane, form preferably an angle of more than ninety degrees, but less than 180 degrees.

It is a further object of the invention to provide a safe with a door wing which is laterally retractable into a lateral retraction space which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which a preferred embodiment of the invention is illustrated.

DETAILED DESCRIPTION

Figure 1:
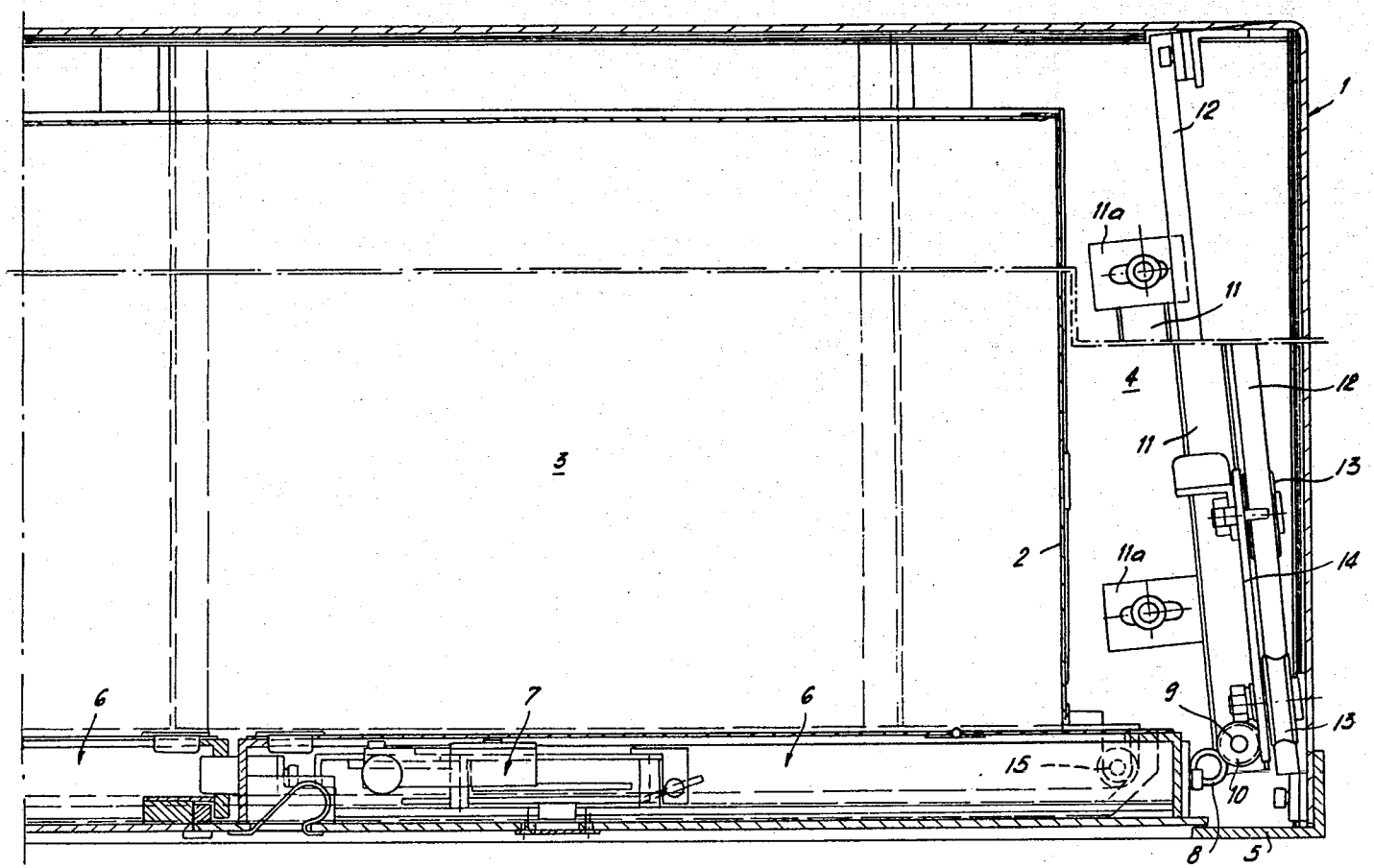
FIG. 1 is a horizontal sectional view of the right hand part of a safe in which the door wings are closed.

The drawings illustrate a safe case 1 having a bottom, a top, and rear 22 and sidewalls, and being open in the front. On either side of the safe, a retraction space 4 is separated, by vertical partitions 2, from a useful space 3. While the door wings 6 are closed, front corner strips 5 cover the respective retraction spaces to about one half; the other half of each respective retraction space is covered by the wing.

The door wings 6 are designed as hollow walls and can be locked to each other in the closed position by means of a locking mechanism 7. On their laterally outward end faces, remote from locking mechanism 7, door wings 6 carry one part of a hinge 8. The other part of the hinge 8 is secured to a vertical supporting column 9. The vertical plane passing through the axes of supporting column 9 and of hinge 8 forms with the door plane an angle ranging between 90 degrees and 180 degrees, and preferably about 140 degrees.

On both ends of the supporting column 9, which project beyond the vertical dimensions of the door opening of safe 1, the supporting column 9 carries a guide roller 10. The guide roller 10 is coaxial with the column 9 and is guided on elongated guides or guide sheets 11 which are secured to the bottom and top walls, respectively, of retraction space 4. As shown in FIG. 1, the horizontally extending guides 11 are obliquely disposed relative to the front and sides of the safe and extend inwardly toward the rear of the retraction space to form an angle about eighty-five degrees with the door opening plane. In order to be able to exactly adjust the oblique position of the guides 11 during installation, which is critical for proper retraction, extending and swinging of the door wings 6, guides 11 are firmly screwed to the case bottom wall by means of slotted straps 11*a*.

A guide rail 12 is provided approximately at mid-height of retraction space 4, somewhat offset outwardly relative to guides 11, but extending exactly parallel thereto. Guide rail 12 is also adjustably mounted on case 1 so as to be able to exactly adjust its oblique extension and horizontal position. Advantageously, upon assembly, guides 11 and guide rail 12 are permanently fixed in their accurately adjusted position.

Guide rail 12, which extends up to the rear wall of case 1, is designed with an upper and lower track surface, each of which has a convex cross-section. Track rollers 13, each having a correspondingly concave running face, are guided on each of the track surfaces. The two track rollers 13 turn about horizontal axes and are adjustably mounted on a supporting plate 14 which extends parallel to rail 12, at locations which are spaced apart in the longitudinal direction of rail 12. Supporting plate 14 is firmly secured to the supporting column 9. The upper track roller 13 is located closer to column 9 than the lower track roller 13.

Figure 3:
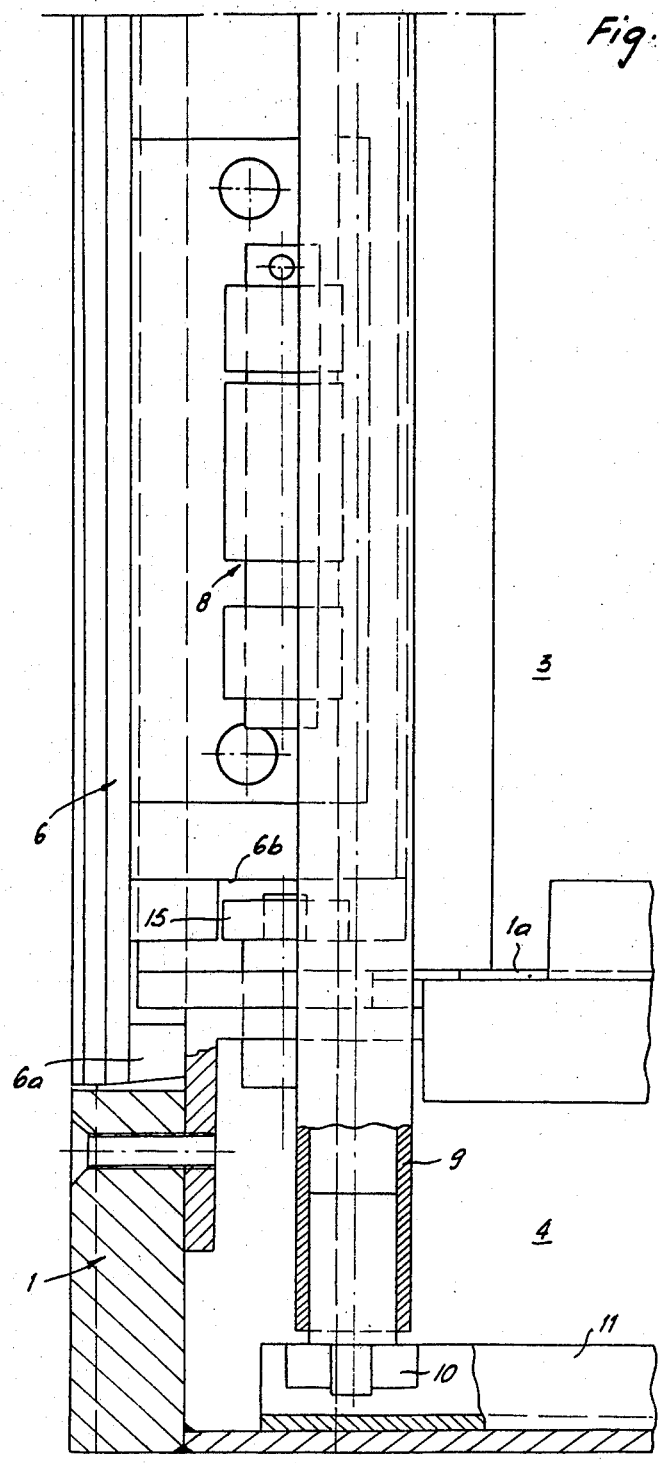
FIG. 3 is an enlarged vertical sectional view of the front part of the right hand retraction space of the safe of FIG. 1, with the door wing closed.

As shown in FIG. 3, the lower end portion of supporting column 9, carrying the lower guide roller 10, extends downwardly below a bottom sheet 1*a* limiting the useful space 3 of the safe.

Door wings 6, projecting below the plane of bottom sheet 1*a* by a fireproofing recess 6*a*, is provided with a guide groove 6*b* on its underside. Guide groove 6*b* is engaged by a guide roller 15 rotating about a vertical axis. The guide roller 15 is operatively mounted to the case 1. The axis of guide roller 15 forms the fixed pivot point for door wing 6 which is located in the door opening plane passing through the hinge axis of hinge 8.

Figure 2:
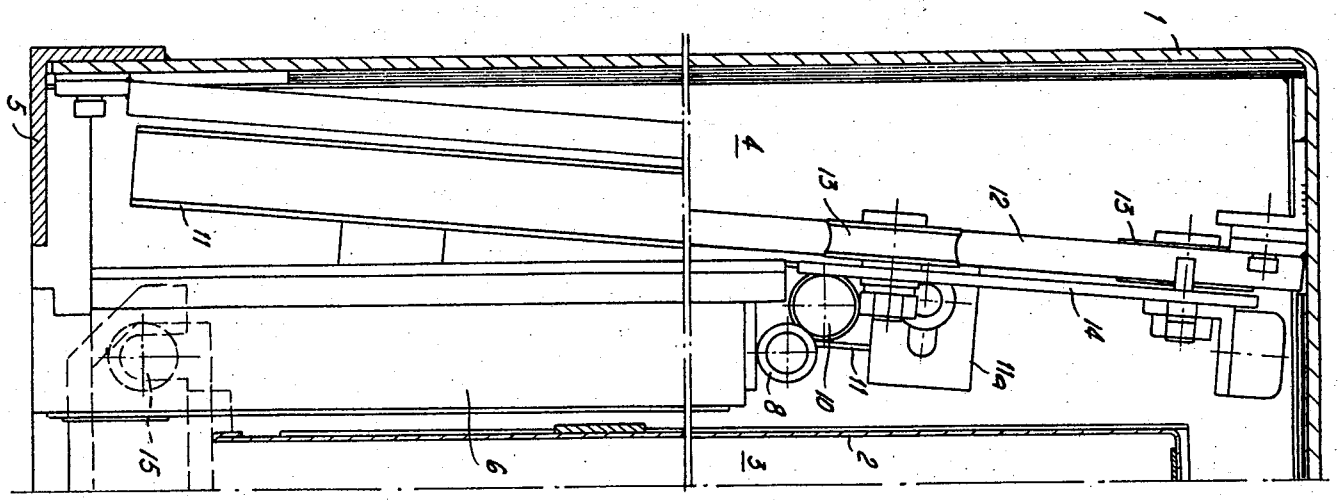
FIG. 2 is an enlarged horizontal sectional view of the left hand part of the safe of FIG. 1, with the door wing retracted.

While opening door wing 6, the wing is pivoted about the hinge axis and simultaneously shifted on and swung about guide roller 15, and supporting column 9 together with track rollers 13 is moved along guide rail 12 into retraction space 4. The continuous introduction as from the start of the door wing edge portion at the external side of the door, into retraction space 4, produces the effect that the space needed in front of the door for pivoting the door wing is substantially smaller than the width of the door wing. It should be noted further that the designed horizontal length of supporting plate 14 projecting from supporting column 9 is such that, with a completely retracted door wing 6 and thus with supporting plate 14 extending closely up to the rear wall of the case (FIG. 2), the front side of door wing 6 is flush with the front of the case and, in practice, closes the front opening of retraction space 4.

The described embodiment results in a relatively large useful space, as compared to the total volume of the safe, and the door wings require only a small pivotal space in front thereof. Consequently, the safe can be installed with particular advantage under limited space conditions, such as in bank counters.

Thus, in accordance with the invention, there is provided a safe having door wings which can be swung open while retracting into lateral spaces, characterized in that each of the door wings 6 are jointed by means of hinges 8 to an associated supporting column 9 and pivotable about a guide roller 15 which is provided in the vicinity of the retraction space 4. The guide roller 15 is rotatable about a vertical axis and engages an underside guide groove 6*b* of the door wing. Two concurrent track rollers 13 are mounted at horizontally and vertically offset locations on a supporting bar 14, which is secured to the supporting column 9, and have concave running faces by which the track rollers 13 run on conformable convex upper and lower track surfaces, respectively, of a guide rail 12 which extends at about the mid-height of the door obliquely inwardly through the retraction space 4 to the rear thereof, with the track rollers 13 being adjustable vertically and the guide rail 12 being adjustable vertically and horizontally and both the rollers and the rail being fixable in their desired adjusted positions, so that to open the door, the door wing 6 is pivoted from its closed position in which it covers the front opening of the retraction space, about the hinge axis 8 and simultaneously is shifted on and turned about the guide roller 15 through ninety degrees and is moved, with the supporting column 9 ahead thereof, along the guide rail 12 into the retraction space, to an open position in which the front face of the door wing closes the retraction space while being flush with the front opening thereof.

In the illustrated embodiment, the supporting column 9 is guided at its top and bottom by means of guide roller 10 rotating about vertical axes, in guides 11 which extend parallel to the guide rail 12.

The guides 11 are preferably adjustable by means of slotted flanges 11*a* and are fixable in their adjusted position.

While a specific embodiment of the invention has been shown and described in detail to illustrate the application of the principles of the invention, it will be understood that the invention may be embodied otherwise without departing from such principles.

What is claimed is:

1. An improved safe of the type having a case defining an enclosed volume and a door opening opened to the volume, wall means for dividing the volume into a useful space and a retraction space laterally adjacent to the useful space, and at least one door wing, wherein the door wing is laterally swingable out of the door opening and concurrently retractable into the retraction space, comprising, a supporting column, hinge means swingably mounting the door wing to the supporting column, a guide roller mounted proximate the retraction space for rotation in engagement with the door wing, a guide rail extending obliquely inwardly through the retraction space from the plane of the door opening, an elongated supporting plate fixedly mounted to said supporting column, a first roller and a second roller mounted to said supporting plate at horizontally and vertically offset positions and engaged to said guide rail for rotation therealong, and said supporting column being movable along said guide rail so that to open the safe, the door wing is pivoted from its closed position in the door opening plane about the hinge access of said hinge means and is simultaneously shifted on and turned about said guide roller through ninety degrees and moved into an open position in which an edge of the door wing is flush with the door opening plane.

2. The safe, according to claim 1, further comprising a movable guide roller rotatably mounted to each end of said supporting column, an elongated guide member guidably engaged to said movable guide roller for guiding said movable guide member therealong, and said elongated guide member being extended parallel to said guide rail.

3. The safe, according to claim 2, further comprising, first adjusting means for adjusting the position of said elongated guide member and fixing said elongated guide member in an adjusted position.

4. The safe, according to claim 1 or 2 or 3, further comprising, second adjusting means for adjusting the vertical and horizontal position of said guide rail and for fixing said guide rail in an adjusted position.

5. The safe, according to claim 4, wherein said guide rail includes opposite convex-shaped running surfaces, and said first and second rollers have concave running faces mounted to respective ones of said convex-shaped running surfaces.

6. The safe, according to claim 5, wherein said edge of the door wing flush with the door opening plane in the open position is dimensioned to substantially cover the door opening adjacent said retraction space in the open position.

7. The safe, according to claim 1, wherein said guide rail is disposed relative to the door opening plane with an angle therebetween ranging from 80 to 85 degrees.

* * * * *